United States Patent [19]

Presley

[11] 4,111,388

[45] Sep. 5, 1978

[54] VERTICAL PIPE HOLDING TOOL

[76] Inventor: J. M. Presley, Rte. 4, Box 78, Enterprise, Ala. 36330

[21] Appl. No.: 798,013

[22] Filed: May 18, 1977

[51] Int. Cl.[2] ..... E21B 19/14

[52] U.S. Cl. ..... 248/49; 166/77.5; 166/85; 214/2.5

[58] Field of Search ..... 248/49; 24/249 DP; 166/77, 77.5, 85; 294/90, 91; 173/165, 166, 167; 81/57.16, 57.34; 285/64, 61, 140, 141; 269/287, 321 N; 29/700, 781, 237, 236; 214/1 P, 2.5; 175/85

[56] References Cited

U.S. PATENT DOCUMENTS

| | | | |
|---|---|---|---|
| 1,017,869 | 2/1912 | Guiberson | 294/91 |
| 2,245,938 | 6/1941 | Ratigan | 294/90 |
| 2,273,214 | 2/1942 | McConaghy | 285/61 X |
| 2,662,791 | 12/1953 | Kittler | 294/91 |
| 2,829,783 | 4/1958 | Blagg | 214/1 P X |
| 3,463,247 | 8/1969 | Klein | 166/77.5 X |
| 3,527,295 | 9/1970 | Gangl et al. | 166/85 |
| 3,739,434 | 6/1973 | Wheeler | 24/249 DP |
| 3,779,594 | 12/1973 | Monroe | 24/249 DP X |
| 3,829,077 | 8/1974 | Strybel | 269/287 X |
| 3,913,687 | 10/1975 | Gyongyosi et al. | 166/77.5 X |

*Primary Examiner*—Rodney H. Bonck

*Attorney, Agent, or Firm*—Cushman, Darby & Cushman

[57] ABSTRACT

A vertical pipe holding tool comprising a flat base member and a forked member. The base is slotted such that it can be fit around a vertically disposed length of pipe, and includes projecting members having a vertical side adjacent the slot. Two of the projecting members are relatively disposed at a predetermined angle. The forked member includes arms having vertical exterior sides relatively disposed at the predetermined angle, and adjacent interior sides forming a predetermined angle, preferably 55°. The exterior surface of the forked member arms engage the interior surface of the base projection members to form a generally triangular aperture of such dimensions as to permit passage of pipe but restricting passage of pipe couplings. The apex of the triangle provides for passage of electrical cables fixed to the pipe exterior. The engagement between the projecting members and forked arms prevents accidental disengagement due to jostling.

16 Claims, 4 Drawing Figures

26

128
34
15°

55
52b
50b
26
18
52a
32
20
12
10
16
30
56
50a
58
PUMP
54

VERTICAL PIPE HOLDING TOOL

The present invention relates to apparatus for holding a vertically disposed string of pipe and, in particular, an apparatus for holding a string of galvanized or PVC pipe lengths while connecting or disconnecting joints for lowering the pipe string into or raising the pipe string from a well.

Often in the construction or repair of a well, a pump is lowered into (or raised from) a well casing at the end of a string of coupled lengths of pipe, where the other end of the pipe string is coupled to a hoist cable. The lowering or raising of the pump is typically performed on a length-by-length basis, utilizing a vice or other tool to prevent the pump from dropping into the well casing while a length of pipe is coupled to (or decoupled from) the pipe string. The couplings used are generally of greater diameter than the pipe, having interior (female) threads for cooperation with exterior (male) threads on the ends of each pipe length. Presently available vices or other tools are disadvantageous in that they are often subject to accidental disengagement due to jostling, dropping the pump and pipe string into the well casing, and often resulting, in addition to a loss of the pump, in a complete loss of use of the well. Existing vices and pipe holders often cannot accept an already vertically disposed pipe without disconnecting the string from the hoist cable, nor can they be installed or removed while the string of pipe is in motion.

Further, electrical cables associated with the pumps are also fed down the well casing. It is desirable to fasten the cable to the string of pipes, to keep it taut. Where slack is allowed in the cable, there is a possibility of the cable wedging between the side of the pump and the well casing while the pump is being raised from the well, causing the pump to stick in the well casing and often resulting in loss of the pump and loss of the use of the well.

The present invention is directed to a vertical pipe holding tool which can be fitted to an already vertically disposed pipe string, even when the pipe string is in motion, provides against accidental disengagement due to jostling and further provides for passage of an electrical cable affixed to the pipe exterior. A detailed description of a preferred embodiment follows with reference to the accompanying drawings wherein like numerals denote like elements and wherein.

Figure 1:
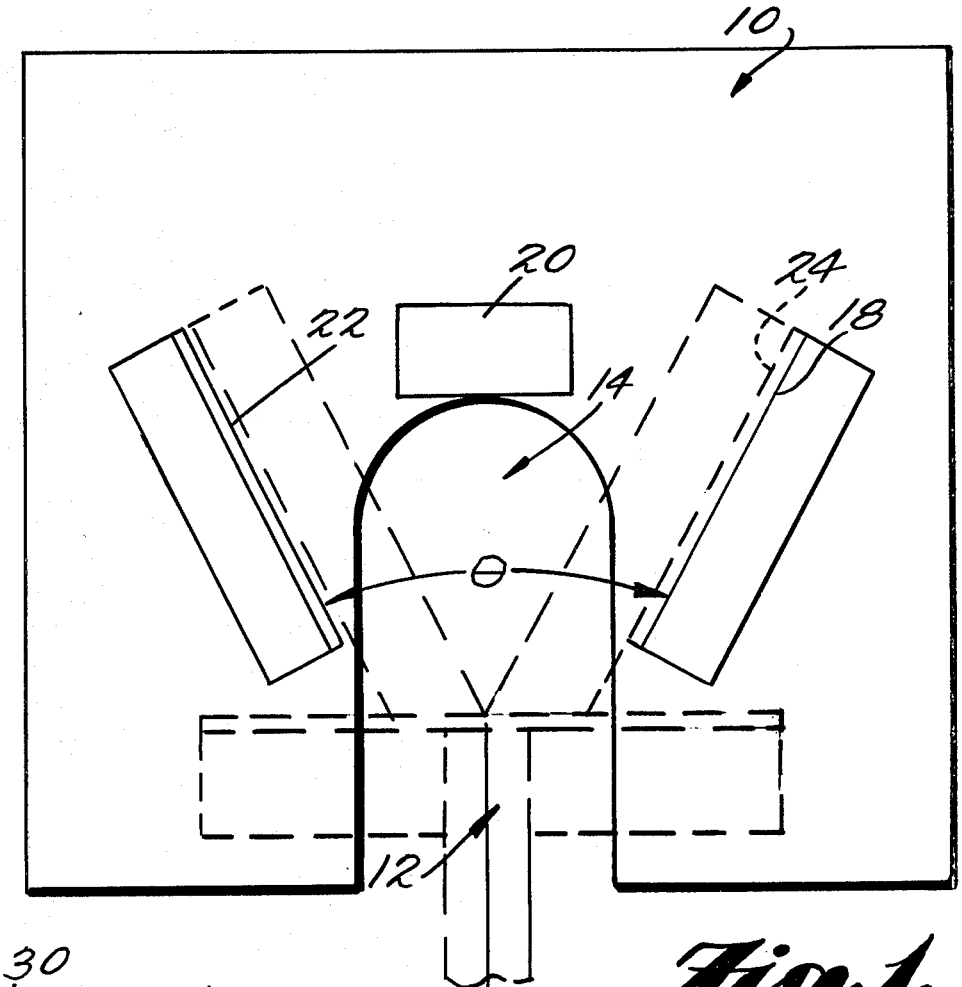
FIG. 1 shows a top plane view of a base member in accordance with the present invention.
Figure 2:
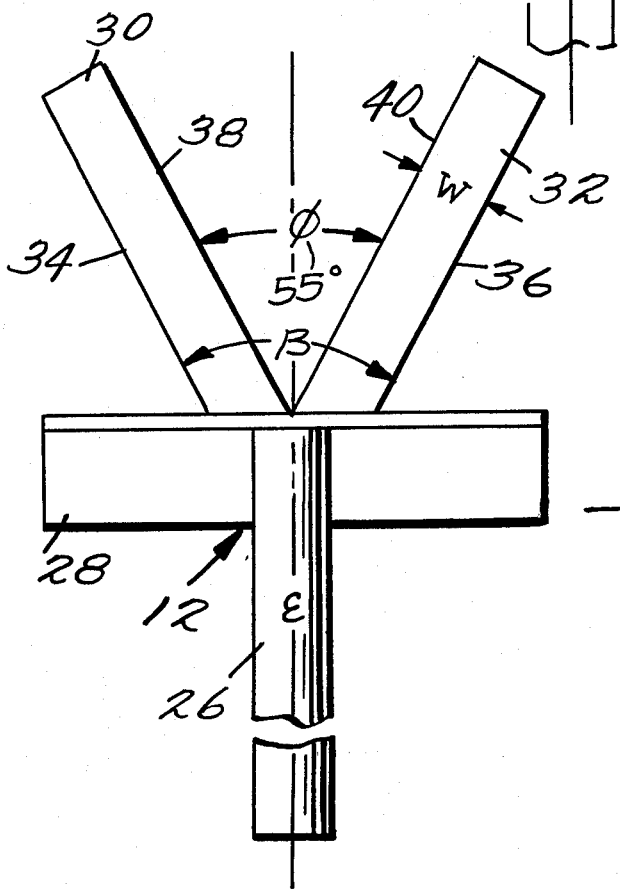
FIG. 2 shows a top plan view of a forked member in accordance with the present invention.

Referring now to FIGS. 1 and 2, a vertical pipe holding apparatus in accordance with the present invention comprises a generally planar base member 10, and a forked-shaped member 12. As will be more fully explained in conjunction with FIG. 4, base member 10 is horizontally disposed on top of a well casing and is of dimensions greater than the diameter of the casing. Base member 10 includes a cut-out portion or slot 14, extending inwardly from one edge of base 10 a predetermined distance. The width of slot 14 is chosen such that it will allow passage of the couplings on the largest diameter pipe upon which the tool is to be used. For example, where base 10 is to be used on standard pipes having nominal diameters of up to $1\frac{1}{4}''$, slot 14 is preferably terminated in a semi-circle having a radius of $1\frac{1}{8}''$. Where base 10 is to be used with pipes up to such $1\frac{1}{4}''\lambda$ diameter and on standard 6" well casings, base 10 is preferably 8" square and $\frac{3}{8}''$ thick with slot 14 being centrally located and extending a distance $4\frac{1}{8}''$ inwardly from the edge of base 10.

Affixed to base 10, suitably by welding or by bolts (not shown), are projecting members 16, 18 and 20. Projecting members 16 and 18 are disposed on opposite sides of slot 14, preferably symmetrically, and have interior surfaces 22 and 24 adjacent slot 14. Interior surfaces 22 and 24 are preferably vertical and are relatively disposed at a predetermined angle $\theta$. Projecting member 20 is tangentially disposed proximate to the terminating edge of slot 14.

Figure 3:
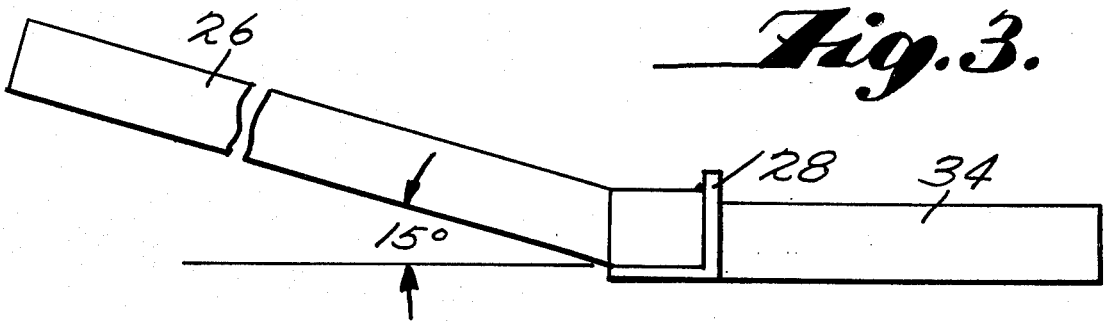
FIG. 3 is a side view of the forked member in accordance with the present invention.

Fork member 12 comprises a handle portion 26 coupled to a cross-member 28 and first and second engaging members or arms 30 and 32 which are affixed at one end to cross member 28 (or to handle 26) and extend outwardly therefrom. Handle 26 is preferably formed of a steel rod and, as shown in FIG. 3, handle 26 is preferably disposed at an angle with respect to the horizontal, suitably 15°, to facilitate gripping by a user's hand. The cross-member 28 is preferably formed of a so-called angle iron and is of transverse width greater than the width of slot 14. Handle 26 is affixed, suitably by welding, to the interior angle of cross-member 28 and arms 30 and 32 are affixed to the exterior vertical surface thereof.

Arms 30 and 32 are preferably rectangular in shape, with parallel interior (38,40) and exterior (34,36) vertical surfaces. The width W of arms 30 and 32 are chosen in accordance with the diameter of the pipe with which the tool is to be used. Fork arm exterior surfaces 34 and 36 are disposed with respect to each other at an angle $\beta$ substantially equal to the predetermined angle $\theta$ between projecting member surfaces 22 and 24 and are adapted to abut with and engage surfaces 22 and 24. Fork arm interior vertical surfaces 38 and 40 form therebetween an angle $\phi$, chosen in accordance with the diameter of the pipe with which the tool is to be used. Angle $\phi$ is preferably symmetrical about the axis of handle 26 and is preferably on the order of 55° for pipes up to $1\frac{1}{4}''$ diameter.

Where a single base 10 is to accommodate various diameter pipes, slot 14 is made of a width great enough to pass the couplings on the largest diameter pipe and projecting surfaces 22 and 24 are positioned to engage the exterior surfaces of arms 30 and 32 accordingly. To accommodate a pipe of smaller diameter, a forked member 12 having arms with exterior surfaces 34 and 26 adapted to engage projecting surfaces 22 and 24 is utilized, but the width W of arms 30 and 32 is, in effect, increased to provide a smaller aperture between base 10 and fork arm interior surfaces 38 and 40. It should be appreciated that a single fork member 12 of dimensions corresponding to the largest diameter pipe can be, if desired, adapted to utilize inserts to the interior angle to effectively increase the width of arms 30 and 32 to accommodate smaller diameter pipes.

It should be appreciated that interior surfaces 38 and 40 need not be parallel to the corresponding exterior surfaces 34 and 36, nor need arms 30 and 32 be of equal width. It is only requisite that exterior surfaces 34 and 36 be relatively disposed in accordance with the relative disposition of projecting surfaces 22 and 24 such that there is engagement between the respective surfaces. Further, projecting surfaces 22 and 24 and fork arm exterior surfaces 34 and 36 need not necessarily be vertical, so long as the respective angles correspond.

Figure 4:
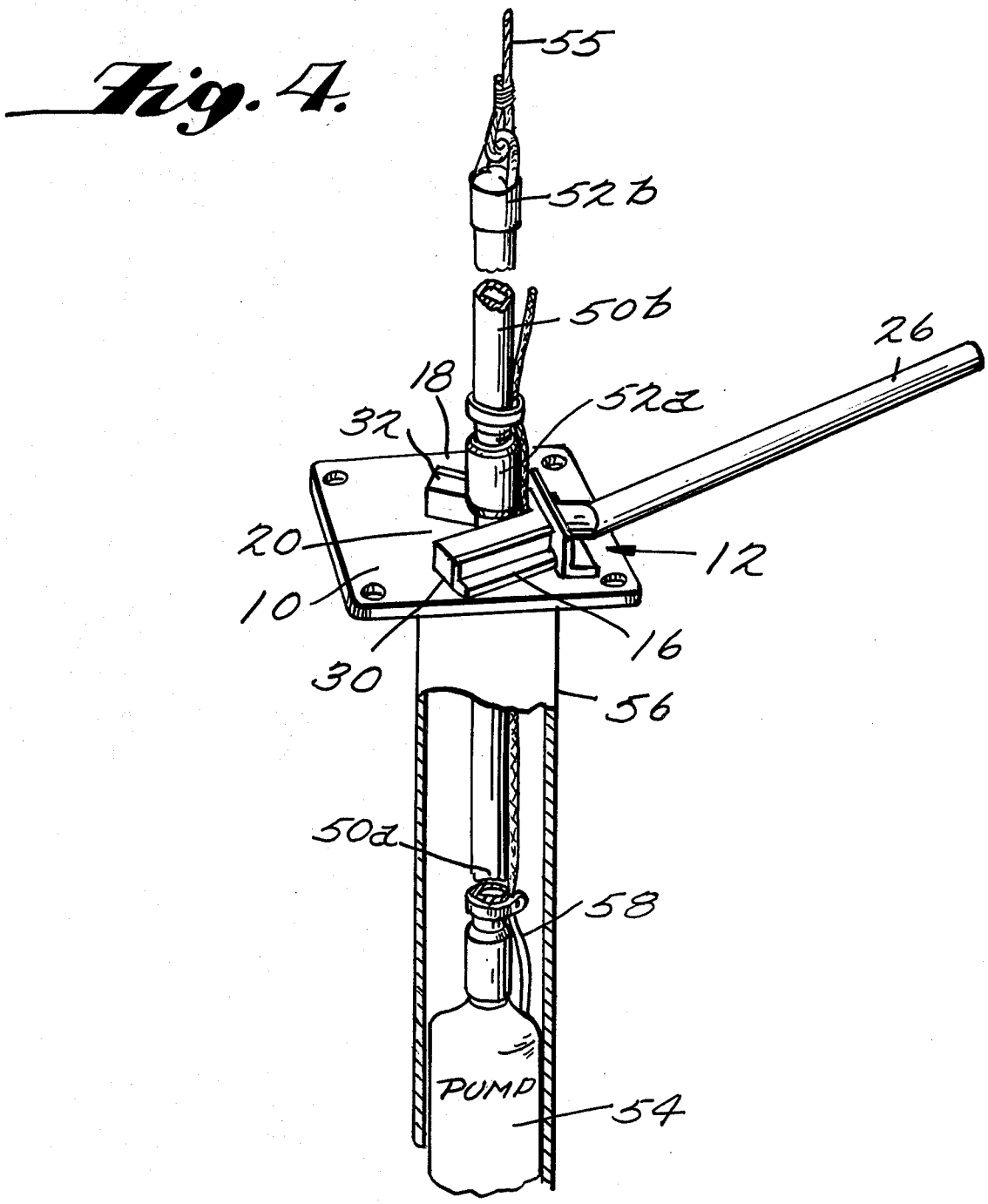
FIG. 4 is a pictorial schematic illustrating the use of the present invention.

With reference to FIG. 4, the operation of a vertical pipe holding apparatus in accordance with the present invention will be described. A plurality of lengths of pipe 50 (50*a*, 50*b*, 50*c*) are formed into a pipe string by couplings 52. The pipe string is attached at one end to a pump 54 and, at the other end, to a hoist cable 55. The pipe string is vertically disposed within a well casing 56. An electrical cable 58 associated with pump 54 is also disposed within well casing 56, affixed (such as by taping) to the pipe string at intervals to prevent slack in the cable. As noted above, if slack existed, the cable might wedge between the edges of pump 54 and well casing 56, causing pump 54 to stick in the well casing. Base 10 is placed on the top of well casing 56 with slot 14 fitting around pipe 50. As previously noted, the dimensions of slot 14 are such that pipe 50 and couplings 52 can pass freely therethrough. Forked member 12 is then placed on the surface of base 10, with the exterior surfaces of fork arms 30 and 32 engaging the interior surfaces of projecting members 16 and 18. A generally triangular opening is thus formed by the interior surfaces of fork arms 30 and 32 and the edge of slot 14 or, equivalently, the tangential edge of projecting member 20. The triangular opening is large enough to pass pipe 50 but restricts passage of coupling 52. The edge of coupling 52 thus rests on the upper surfaces of fork arms 30 and 32 and, where projecting member 20 is of the same height, on its upper surface as well. The engagement between fork arms 30 and 32 and projecting members 16 and 18 prevents accidental dislodging of the pipe due to jostling in lateral directions and the weight of the string of pipes 50 and pump 54 prevents disengagement due to vertical jostling. Projective member 20 and cross member 28 stabilize the pipe string and fork member 12 and prevents torque thereon due to imbalances or lateral jostling. It should be appreciated that the generally triangular shape, when angle $\phi$ is properly chosen, provides an aperture for passage of electrical cables 58 without requiring that it be decoupled from the pipe within well casing 56. Further, a slotted base and open-ended fork arrangement provides for utilization of the holding tool after a string of pipes 50 have been vertically disposed and attached to the hoist cable and even when the pipe string is in motion. Thus, a length of pipe 50*a* coupled at one end to pump 54 and coupled at the other end via a coupling 52*a* (ignoring for the moment pipe 50*b* shown in FIG. 4) is attached to hoist cable 55. Base 10 of the holding tool is fitted around pipe 50*a* and set on the top edge of well casing 56. Fork member 12 is then also fitted around pipe 50 and made to engage projecting members 16 and 18. Electrical cable 58 is suitably taped at intervals to pipe 50. Pipe 50 is lowered into well casing 56 until passage of coupling 52 is restricted by forked member 12 whereupon the hoist cable 55 is decoupled from coupling 52*a*; one end of a second length of pipe 50*b* having a further coupling 52*b* on the other end thereof is threaded into coupling 52*a* in the place of the hoist cable and the hoist cable is then threaded into coupling 52*b*. The string of pipe 50 is slightly raised and forked member 12 removed to permit passage of coupling 52*a*, and then replaced to restrict the passage of the coupling 52*b*, for a repetition of the process.

A similar procedure is utilized for raising pump 54 from the well casing wherein forked member 12 is removed to permit upward passage of the uppermost coupling 52, then re-set in place. The pipe string is then lowered to set the edge of the coupling against forked member 12, the uppermost length of pipe is then removed from the coupling and replaced with the hoist cable.

It will be understood that the above description is of illustrative embodiments of the present invention and that the invention is not limited to the specific form shown. Modifications may be made in the design and arrangement of the elements without departing from the spirit of the invention, as will be apparent to those skilled in the art.

What is claimed:

1. Apparatus for holding a vertically disposed pipe of a first predetermined diameter, said pipe having a portion having a second predetermined diameter greater than said first predetermined diameter, comprising in combination:

a base member including a slot extending inwardly a predetermined distance from one edge of said base member, said slot being wider than said second predetermined diameter;

first and second projecting members affixed to said base member, each having an interior surface transverse to said base member, said projecting member interior surfaces being disposed on opposite sides of said slot, and relatively disposed at an angle opening away from said one base member edge; and a fork member, including a handle and first and second engaging members, said engaging members being affixed at one end to said handle member and extending outwardly therefrom, said engaging members having exterior transverse surfaces relatively disposed at an angle for removably engaging said projecting member interior transverse surfaces, said fork member, when engaged, forming an opening with dimensions at least as great as said first predetermined diameter, but less than said second predetermined diameter said opening including a portion associated with said fork member interior angle apex of lesser width but extending beyond said second predetermined diameter.

2. The apparatus of claim 1 wherein said transverse surfaces are perpendicular to said base member.

3. The apparatus of claim 1 further including a third projecting member affixed to said base member, having a transverse surface adjacent the innermost edge of said slot, said third projecting member and said engaging members being of substantially equal transverse height.

4. The apparatus of claim 1 wherein said engaging members have adjacent interior surfaces, disposed at said angle.

5. The apparatus of claim 1 wherein said fork member further comprises a cross-member wider than said base member slot, and adapted to overlie said slot to stabilize said fork member on said base member.

6. Apparatus for holding a vertically disposed pipe of a first predetermined diameter, said pipe having a portion having a second predetermined diameter greater than said first predetermined diameter, comprising in combination:

a generally flat base member, said base member being horizontally disposed and including a slot extending inwardly a predetermined distance from one edge of said base member, said slot being at least as wide as said second predetermined diameter, to admit said pipe through said slot;

first and second projecting members affixed to said base member, each having a flat interior surface transverse to said base member, adjacent the edges of said slot, said projecting member interior surfaces being disposed on opposite sides of said slot, and relatively disposed at a first predetermined angle, said angle opening away from said one base member edge; said apparatus further comprising:

a fork member, including a handle and first and second engaging members, said engaging members being affixed to one end said handle member and extending outwardly therefrom, said engaging members having adjacent interior transverse surfaces and exterior transverse surfaces, said exterior surfaces being relatively disposed at said first predetermined angle, and said engaging member interior surfaces being relatively disposed at a second predetermined angle;

said engaging member exterior transverse surfaces being adapted to removably engage said projecting member interior transverse surfaces to form between said slot and said engaging member interior surfaces an opening with dimensions at least as great as said first predetermined diameter, but less than said second predetermined diameter and including a portion of lesser width than but extending beyond said second predetermined diameter.

7. The apparatus of claim 6 wherein the exterior and interior transverse surfaces of said first engaging member are disposed in parallel, and the exterior and interior transverse surfaces of said second engaging member are disposed in parallel.

8. The apparatus of claim 7 wherein said first and second predetermined angles each equals approximately 55°.

9. The apparatus of claim 6 wherein said transverse surfaces are vertically disposed.

10. The apparatus of claim 9 wherein the exterior and interior vertical surfaces of said first engaging member are disposed in parallel, and the exterior and interior vertical surfaces of said second engaging member are disposed in parallel.

11. The apparatus of claim 10 wherein said first and second predetermined angles each equals approximately 55°.

12. The apparatus of claim 6 wherein said fork member further comprises a cross-member wider than said base member slot, and adapted to overlie said slot to stabilize said fork member on said base member.

13. The apparatus of claim 12 wherein said transverse surfaces are vertically disposed.

14. The apparatus of claim 13 wherein the exterior and interior vertical surfaces of said first engaging member are disposed in parallel, and the exterior and interior vertical surfaces of said second engaging member are disposed in parallel.

15. The apparatus of claim 14 wherein said first and second predetermined angles each equals approximately 55°.

16. The apparatus of claim 12 further including a third porjecting member affixed to said base member, having a transverse surface adjacent the innermost edge of said slot, said third projecting member and said engaging members being of substantially equal transverse height.

* * * * *